United States Patent [19]

Sorensen

[11] 3,952,573

[45] Apr. 27, 1976

[54] ARTICULATED AIR LEAD-IN LINKAGE FOR CAN BODY MAKER

[75] Inventor: Roy E. Sorensen, Lombard, Ill.

[73] Assignee: Continental Can Company, Inc., New York, N.Y.

[22] Filed: Apr. 21, 1975

[21] Appl. No.: 569,911

[52] U.S. Cl. ..... 72/342; 72/345; 72/347

[51] Int. Cl.[2] ..... B21D 22/20

[58] Field of Search ..... 72/342, 344, 345, 347, 72/463

[56] References Cited

UNITED STATES PATENTS

| | | | |
|---|---|---|---|
| 2,036,182 | 3/1936 | Singer | 72/463 |
| 2,378,068 | 6/1945 | Eason | 72/345 |
| 3,402,591 | 9/1968 | Maeder | 72/345 |
| 3,524,338 | 8/1970 | Bozek | 72/345 |

*Primary Examiner*—Lowell A. Larson
*Attorney, Agent, or Firm*—John J. Kowalik; Joseph E. Kerwin; William A. Dittmann

[57] ABSTRACT

An air lead-in for a can body former of the type comprising a ram having a can-forming punch at its end which draws and wall-irons a metal blank by forcing it through a series of rings, the ram and punch having air passages therein through which compressed air is pulsed in a programmed series to faciliate stripping a formed can from the punch. The lead-in comprises novel linkage having articulatingly connected oscillating sections with interconnected air passages therein one end of the linkage having a pivot connection to the ram passages at one end and the other end having a connection to a rocker drive arm air passages from a source external of the arm.

11 Claims, 2 Drawing Figures

ARTICULATED AIR LEAD-IN LINKAGE FOR CAN BODY MAKER

DISCUSSION OF THE PRIOR ART

In construction of similar nature, the air connection from an external source through the drive arm to the ram was accomplished by means of flexible hoses. Such hoses, however, are subject to frequent breakage due to fatigue failures resulting from constant and rapid reciprocation of the ram. Various of such flexible hose connections were tried but they all failed prematurely either abrasion against each other or fatigue.

SUMMARY OF THE INVENTION

This invention is directed to a novel linkage which has articulated sections with air passages therethrough for positive air feed from a source to the use point in a ram of a can forming machine.

The invention comprehends providing an air connection form a stationary source to a reciprocating element by means of rigid linkage comprising a plurality of pivotally interconnected sections wherein each section has an air passage therein and the pivot connections having passages arranged to utilize the air pressure to seep oil mix into the rocking joints to maintain lubrication and providing a hydrostatic bearing as well as maintaining the joints cool.

The invention also contemplates the provision of a novel heat dissipating mechanism through conduction via the metal linkage and convection to the surrounding atmosphere.

These and other objects and inventions inherent in and encompassed by the invention will become more readily apparent from the specifications and the drawings, wherein.

DESCRIPTION OF THE INVENTION

Figure 1:
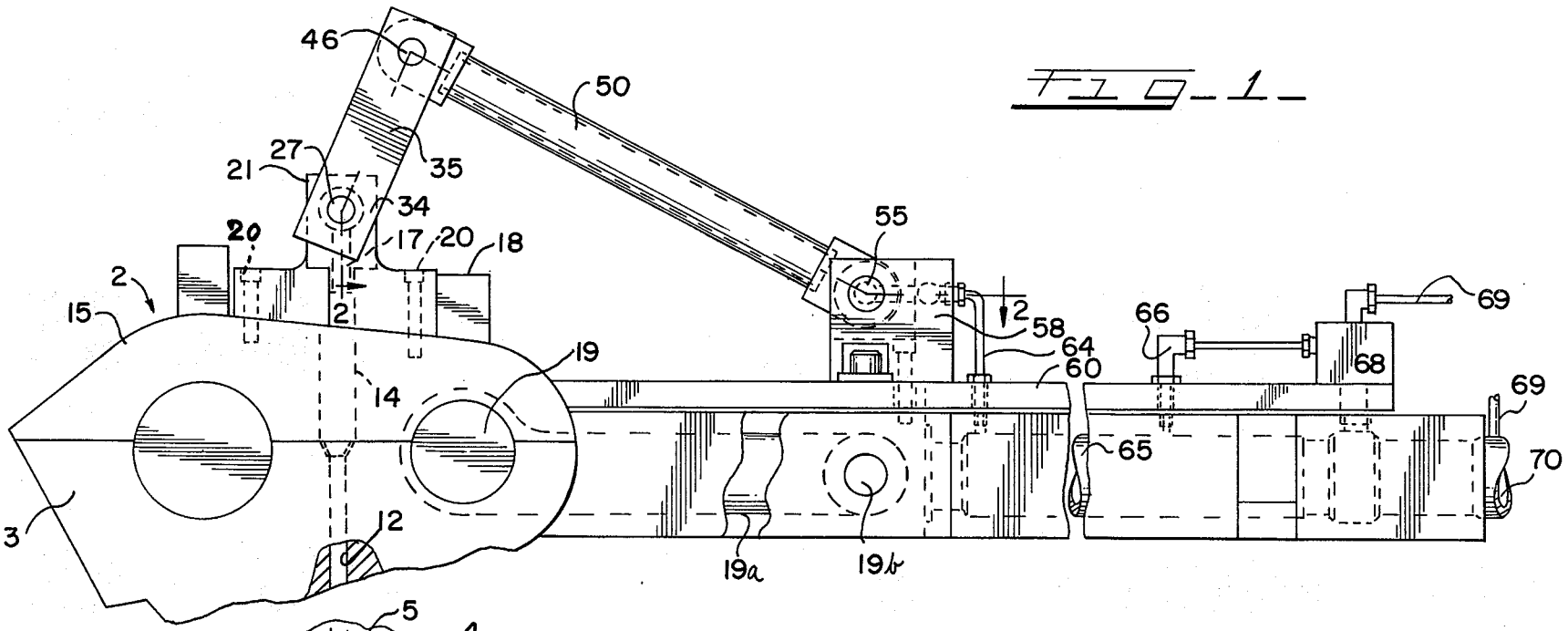
FIG. 1 is a fragmentary side elevational view of the novel invention.

Describing the invention in detail, there is shown a ram and drive assembly therefor generally designated 2 which includes a drive arm or lever 3 which is of well known construction in the art of the type shown in U.S. Pat. No. 3,735,629 and has a lower end 4 pivoted on a horizontal axis by a pin 5 to the main frame 6. The arm is suitably connected to a crank (not shown) for reciprocation thereby.

The stationery pin 5 has an axial passage 9 therein which is connected to a source of pressurized air. The passage 9 leads to a transverse passage 10 of an arcuate extent sufficient to communicate at all times with a longitudinal passage 11 in the arm 3.

Figure 2:
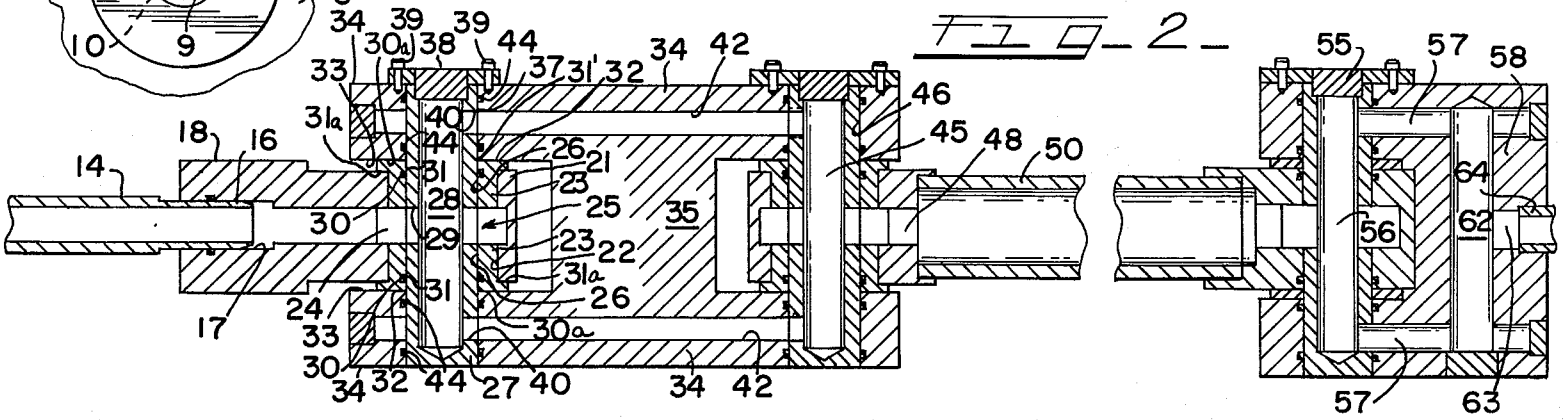
FIG. 2 is a sectional view taken substantially in line 2—2 of FIG. 1.

The passage 12 leads into a tube or pipe 14 (FIG. 2) which is tightly telescoped into passage 12. The tube 14 extends upwardly from the upper end portion 15 of the arm and has a reduced upper end portion 16 (FIG. 2) which extends into passage 17 in a mounting block 18 secured upon the upper end portion of the arm 15 by bolts 20. Arm portion 15 is connected at 19 by a link **19*a* to the ram at 19*b*** to provide differential movement.

The block 18 is provided with an upward lug-like projection 21 which has a transverse horizontal bore 22 therein into which are press-fitted axially-aligned opposed bearing elements 23, 23 which together with an enlarged section 24 of the bore 22 form a cylindrical air passage chamber 25. The bearings 23 provide coaxial bores 26, 26 into which extends a hollow pin 27 having a longitudinal air passage 28 which pin 27 having a longitudinal air passage 28 which communicates via a transverse passage 29 with the chamber 25. The bearings 23 are provided with annular grooves 30 having O-rings 31 fitted therein which embrace the periphery 31 of pin 27 to seal the bearing areas.

The bearings 23 are each rovided with an outturned flange **30*a* which seats on its inner face 31*a* against the external side of the mounting block 18. The external side 32 of each bearing flange 30*a* affords a bearing face against the inner side 33 of 33 of an adjacent one of a pair of legs 34 of an H shaped link 35.**

The link 35 is provided at one end of each leg 34 with a bore 37 through which the pin 27 extends, said pin having a head 38 at one end fastened by bolts 39 to the adjacent leg 34.

The pin 27 has a transverse passage 40 at each end which communicates between passage 28 in pin 27 and longitudinal passages 42, 42 in the legs 34, 34 of the link. Appropriate O-rings seals 44 are provided between pin 27 and the legs 34.

The passages 42, 42 communicate through passages 45 in pin 46 (which is identical with pin 27 and mounted to the other end of legs 34 in the same manner as the one ends of legs 34) with one end of a passage 48 in a link 50 which may be in the form of a metal tube.

The other end of passage 48 communicates through a pivot pin assembly 55 which is same as pin 27, via passages 56 to spaced passages 57, 57 in a mounting block 58 suitably secured to the reciprocating plate and ram assembly 60.

The passages 57 flow into opposite ends of passage 62 in block 58 and thence outwardly through passage 63 into a connecting conduit 64 which is connected to an accumulator chamber 65 forming part of the ram structure. The air exhausts from the chamber through a conduit 66 into a metering valve 68 also mounted on the ram assembly, the air being delivered from valve 68 via a conduit 69 to the ram air passage 70 and thence to the use point at the end of the can forming end of the ram as well known to those skilled in the art.

It will be readily apparent that a simple and effective mechanism has been provided in which the air and lubricant mixture which is ported through the joints serves not only to lubricate the connections but in moving through the linkage particularly through the diagonal almost upright link 35 is effectively prevented from accidentally entraining large dirt particles which would foul the valving. The upright disposition of the link 35 together with the splitting of the air into two channels is conducive to causing any heavy particles to drop out and lay in the low areas. By porting the air from the center toward the outer ends of each joint substantially equalized wear patterns are intended to be achieved since the entire pin is maintained lubricated and thermal unbalance or thermal gradient differentials are essentially eliminated.

It will be appreciated that during reciprocation the mounting block 58, which is directly connected to the ram slide plate which becomes extremely hot in sliding within the frame guideways, becomes hot by thermal conduction. The metal to metal contact with the air passage linkage dissipates excessive heat by conduction and the metal linkage in oscillating back and forth also dissipates the heat into the surrounding atmosphere which a rubber hose of previous construction would not accomplish.

A preferred embodiment of the invention has been disclosed, however, it will be understood that various modification of the invention are anticipated which fall within the scope of the appended claims.

I claim:

1. In a metal forming apparatus of the type comprising a main frame and a longitudinally reciprocal ram having an air passage leading to a can forming use area, and heat generative means mounting the ram from the frame, the improvement comprising:

A linkage for delivering air from a supply source through the air passage in the ram to said use area, said linkage including a plurality of metal links with air passages therein, means pivotally interconnecting said links and having air passages providing communication between the passages in the links, and connection means in thermal conductivity with said linkage and said heat generative means providing a heat sink therefor.

2. The invention according to claim 1 and means communicating with said passages through said connection means (having) and comprising an air (labyrinth therein in heat transfer) chamber (relation to) containing air moving (through said air labyrinth) therethrough for dissipating heat.

3. The invention according to claim 1 and said linkage mounted for oscillation of said links in response to reciprocation of said ram for fanning in the surrounding atmosphere.

4. The invention according to claim 1 and said linkage having at least one substantially upright link providing a drop-out zone for debris entrained in the air passing there through.

5. The invention according to claim 1 wherein said links and ram are arranged in a triangular relationship.

6. The invention according to claim 1 wherein a drive is provided for the ram comprising a drive arm, and means for securing the arm with the ram and effecting differential movement therebetween, and said linkage connected at one end to the arm and at the other end to the ram whereby the differential in movement between the same effects oscillatory movement between the links.

7. The invention according to claim 6 and means connecting the linkage with the ram in heat transfer relationship.

8. The invention according to claim 6 and said links comprising a first link having a lower end connected to the arm and a second link having an upper end connected to the upper end of the first link and having a lower end connected to the heat transfer means.

9. The invention according to claim 8 and said heat transfer means comprising of a metal block having air passage therein for conducting heat from the block to the air passing therethrough.

10. The invention according to claim 9 and said links disposed in upwardly converging relationship to provide a non-linear air conduit.

11. In a can forming apparatus of the type comprising a frame and a longitudinally reciprocal can forming ram having an air passage leading to a can forming use area, the improvement comprising;

a metal linkage for delivering air from a supply source through the air passage in the ram to the use area, said linkage comprising a plurality of tubular metal links with air passages therein, means articulatingly interconnecting adjacent ends of the links to each other having air passages therein providing communication between the passages in said links, means providing a passage connection from said passages in the linkage to said air passage in the ram, a pendulating drive arm mounted on the frame, means operatively connecting the arm to the ram for reciprocating the latter, and means pivotally mounting the other end of the linkage to the ram and the other end of the linkage to the arm.

* * * * *